United States Patent [19]

Ebert

[11] Patent Number: 4,581,781

[45] Date of Patent: Apr. 15, 1986

[54] METHOD FOR INSTALLING WHIRLPOOL BATH APPARATUS

[76] Inventor: Thomas P. Ebert, P.O. Box 1878, Dillon, Colo. 80435

[21] Appl. No.: 680,779

[22] Filed: Dec. 12, 1984

[51] Int. Cl.[4] ..... A61H 33/02

[52] U.S. Cl. ..... 4/542

[58] Field of Search ..... 4/542, 492, 543, 544, 4/541, 507

[56] References Cited

U.S. PATENT DOCUMENTS

| | | | |
|---|---|---|---|
| 3,665,524 | 5/1972 | Jannuzzi, Sr. | 4/507 |
| 3,749,424 | 7/1973 | Greene | 4/507 |
| 4,264,039 | 4/1981 | Moreland | 4/542 |
| 4,349,923 | 9/1982 | Chalberg | 4/542 |
| 4,359,790 | 11/1982 | Chalberg | 4/542 |
| 4,416,030 | 11/1983 | Reynoso | 4/492 |
| 4,419,775 | 12/1983 | Ebert | 4/542 |
| 4,420,846 | 12/1983 | Bonner | 4/542 |

OTHER PUBLICATIONS

*Spa and Sauna,* Apr. 1984, vol. 9, No. 4, p. 16, "Anzen Co. Advertisement".

*Spa and Sauna,* Jan. 1980, vol. 5, No. 1, p. 92, "Hydro Air Industries New Line".

*Pool & Spa News,* Jul. 16, 1984, vol. 23, No. 14, p. 132, "American Products Advertisement".

*Primary Examiner*—Stephen Marcus

*Assistant Examiner*—L. J. Peters

*Attorney, Agent, or Firm*—Mathew R. P. Perrone, Jr.

[57] ABSTRACT

A threaded assembly for installing a whirlpool bath in an in-place bathtub is formed by using a ninety (90°) degree elbow having a slip glue fitting at one end and a female threaded connection at the other end. The female threaded connection cooperates with male threads of an inlet or outlet. The inlet or outlet include a flange which appears on the water side of the tub.

3 Claims, 7 Drawing Figures

Fig. I
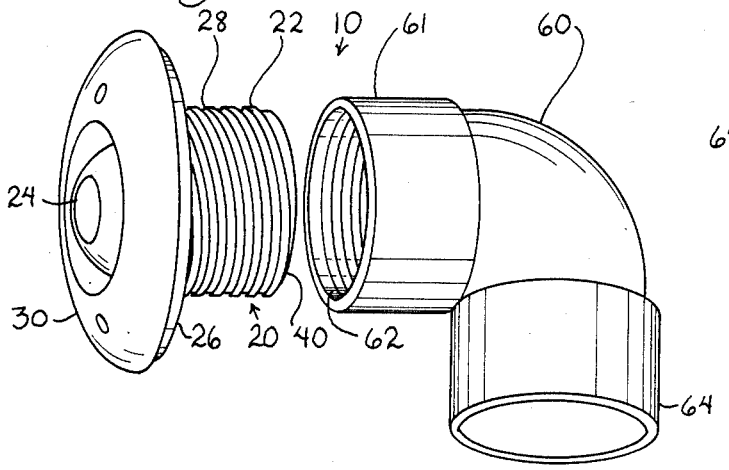
Fig. II
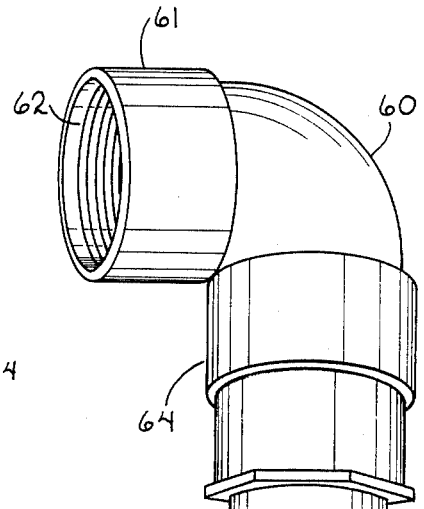
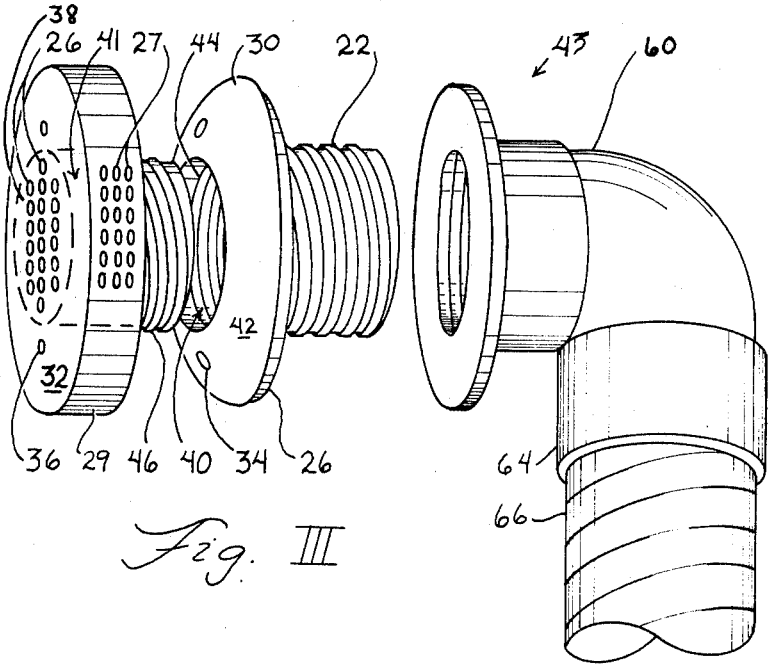
Fig. III
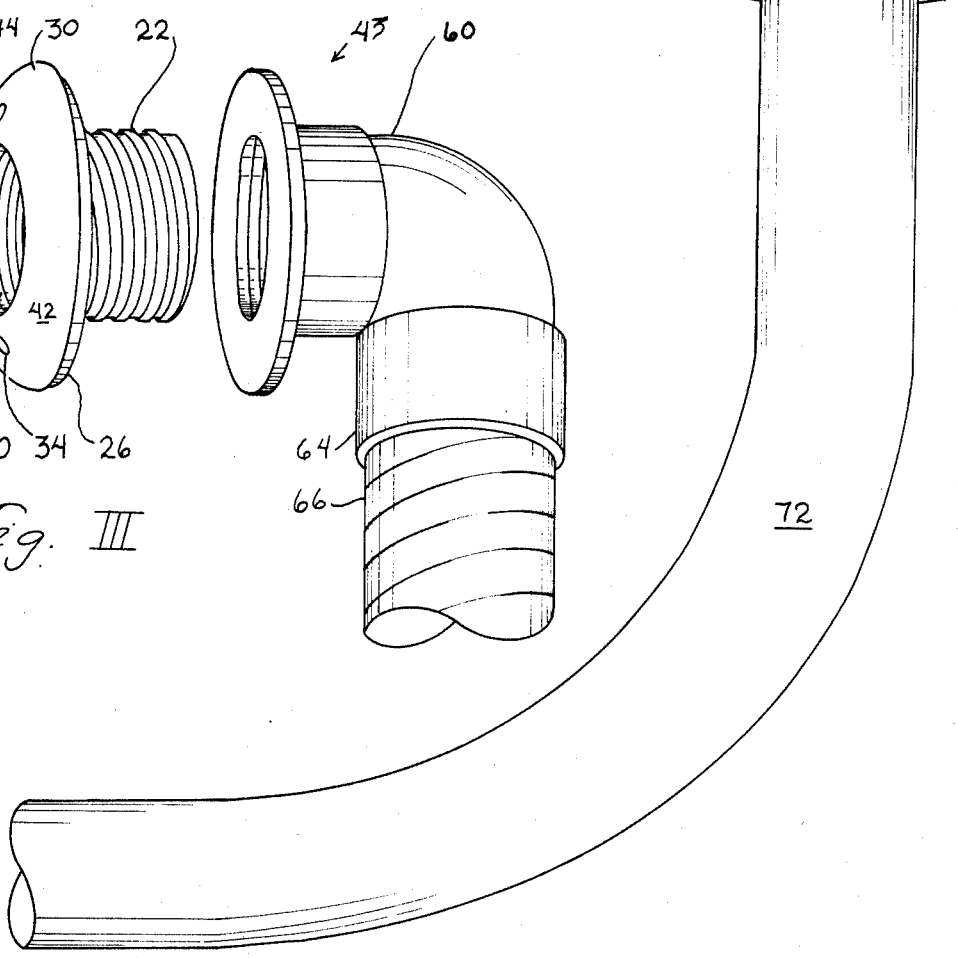

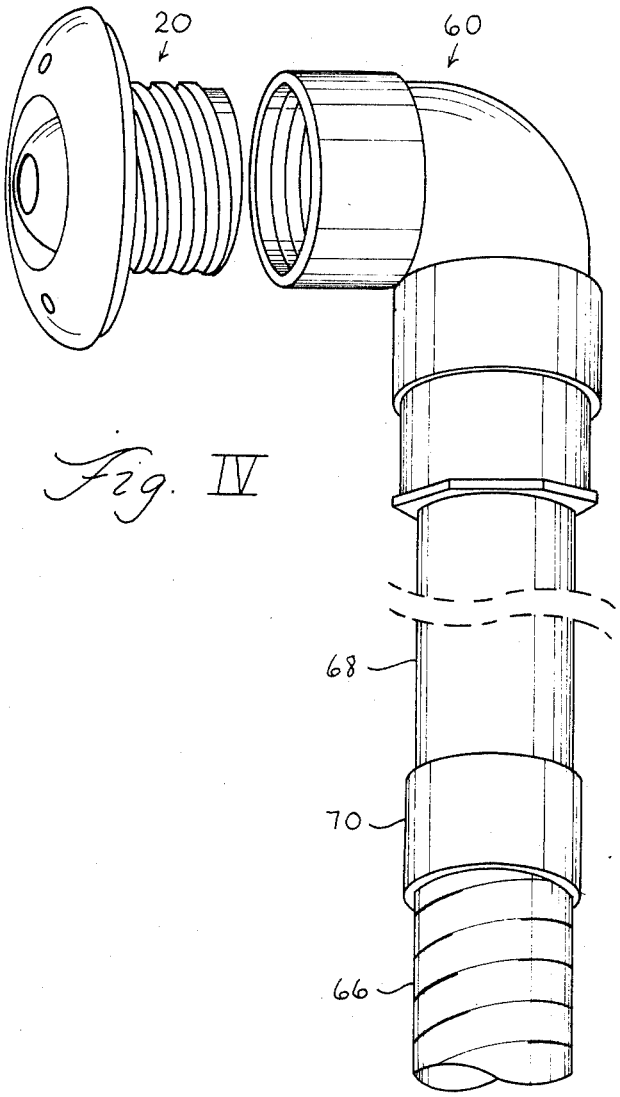
Fig. IV
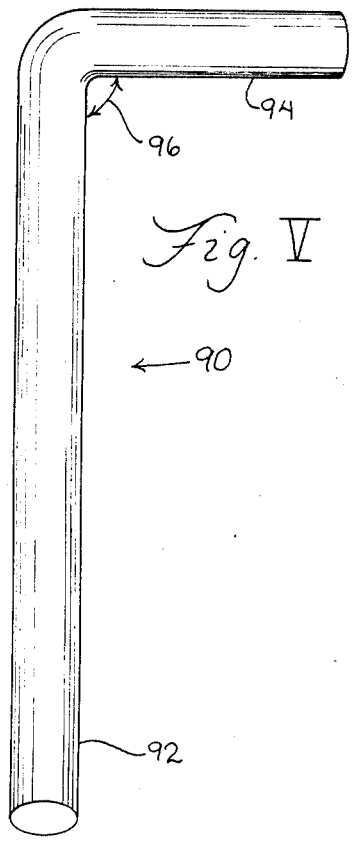
Fig. V
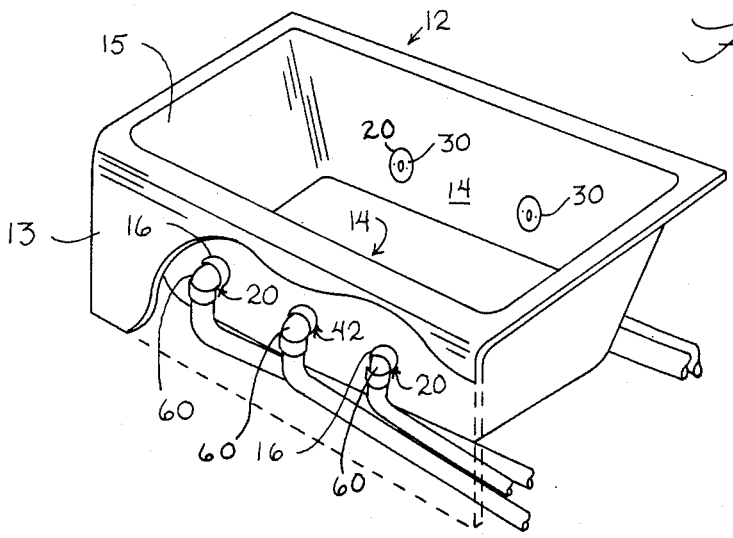
Fig. VI

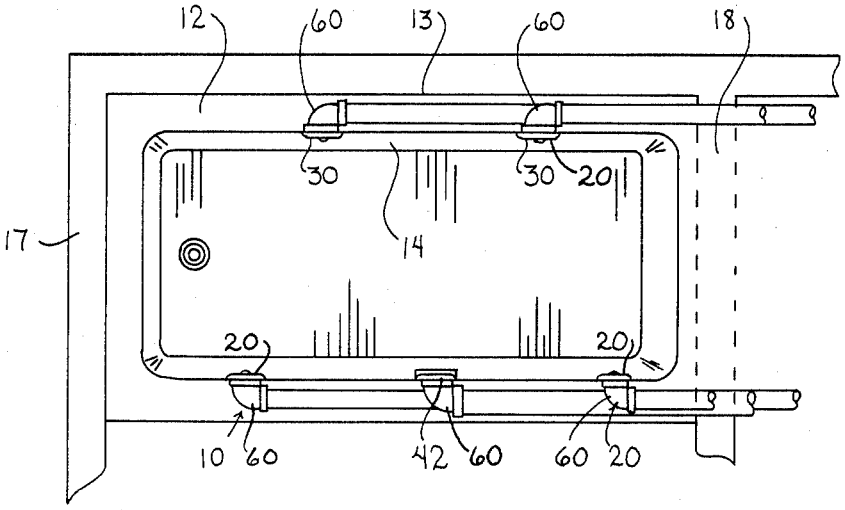
Fig. VII

METHOD FOR INSTALLING WHIRLPOOL BATH APPARATUS

BACKGROUND OF THE INVENTION

This invention relates to a method for installing a whirlpool bath in an in-place bathtub and more specifically to a threadably mounted nozzle for both the inlet and the outlet of the whirlpool bath.

The advantages for having a whirlpool bath are clearly set forth in the U.S. Pat. No. 4,419,775 to Thomas P. Ebert, the same inventor named in this application. The physical treatment and relaxation contributions of the whirlpool bath are clearly set forth.

The problems of installing a whirlpool apparatus in an in-place bathtub are also clearly set forth in the Ebert patent. These problems are solved to a large extent by the method of installation set forth in that particular patent. This particular invention disclosed in the Ebert patent requires the tapping of screw holes into the tub and the mounting of the inlets and outlets therein. There is also a glue type assembly for assembling the model to the flexible or semiflexible hose. This is a very strong reliable fastening.

However, in this course of practicing his invention a simpler method of installation may be discovered by the inventor. Service also becomes simpler. It thus becomes desireable to simplify the installation process and render service simpler.

SUMMARY OF THE INVENTION

Therefore it is an object of this invention to provide a method for installing a whirlpool bath in an in-place bathtub.

A further object of this invention is to provide a whirlpool bath for an in-place bathtub which can be serviced in a simple fashion.

A further object of this invention is to provide a whirlpool bath which may be more simply installed.

These and other objects of this invention are met by havng a hose secured to a ninety (90°) degree elbow. The ninety (90°) degree elbow is held in position adjacent the insert. The nozzle is threaded over the hook which holds the nozzle in position and threadably mounted thereto by means of a female portion being secured inside the elbow and a male threaded portion on the nozzle.

BRIEF DESCRIPTION OF THE DRAWING

FIG. I relates to an exploded view of the threaded assembly 10 of this invention.

FIG. II relates to a ninety (90°) degree elbow 60 having a rigid ninety degree (90°) tube 72 secured thereto.

FIG. III relates to an exploded view of threaded assembly 10 with safety suction cap 32.

FIG. IV relates to an exploded view of threaded assembly with a mixture of flexible hose 66 and rigid pipe 68.

FIG. V depicts an installation hook 90.

FIG. VI depicts a cutaway view of tub 12.

FIG. VII depicts a top view of tub 12 with a wall aperture 18 in wall 17 to give access to the tub 12 and permit use of threaded assembly 10.

Throughout the figures of the drawing, where the same part is used in different figures of the drawing, the same numeral will be applied thereto.

DESCRIPTION OF THE PREFERRED EMBODIMENTS

A threaded assembly for installing a whirlpool bath in an in-place bathtub is formed by using a ninety (90°) degree elbow having a slip glue fitting at one end and a female threaded connection at the other end. The female threaded connection cooperates with male threads of an inlet or outlet. The inlet or outlet include a flange which appears on the water side of the tub. The ninety degree (90°) elbow is between the walls of the tub. This structure is an improvement of the corresponding structure of U.S. Pat. No. 4,419,775 to Thomas P. Ebert, the inventor herein. This application incorporates U.S. Pat. No. 4,419,775 to Thomas P. Ebert by reference.

A whirlpool bath of the Ebert patent includes a tub, a pump assembly, with the pump assembly connected to inlets and outlets within the tub by means of flexible pipes. Depending on the original tub installation, rigid or partially flexible pipe may also be used. Careful installation is required to avoid chipping of a porcelain tub during installation of the whirlpool bath and method of cutting a hole in the porcelain tub is set forth in the Ebert patent. This whirlpool apparatus and method of the Ebert patent and this invention may also be used with a fiberglass tub, with only a slight modification.

Likewise the methods of connecting various parts together may be varied so long as the joints between the various parts do not leak. Thus, parts may be glued, joined by threaded fasteners, or secured in other fashion. As is known in the plumbing art, parts may be made of metal, plastic, synthetic resin or equivalent material. Such material change is well within the scope of this invention so long as the structural and method requirements can be met.

When rigid or partially flexible pipe is used, the in-place installation method of this invention may still be used. The rigid or partially flexible pipe is especially useful if access can be had at both ends of the tub. With such access, the rigid or partially flexible pipe may have a ninety degree joint for a forty-five degree joint affixed thereto in a standard fashion. The inlets or outlets can then be affixed to the other end of the ninety or forty-five degree joint in a standard fashion—such as by gluing. Similarly, the pump end of the pipe may be connected thereto in a standard fashion. Thus rigid or partially flexible pipe may also be used.

In FIG. I is depicted an exploded view of threaded assembly 10. Threaded assembly 10 includes a nozzle 20 and ninety degree (90°) elbow 60. Nozzle 20 has a male threaded end 22 on one side thereof and an outlet 24 on the other side thereof and oppositely disposed therefrom. Mounted over the male threaded end 22 is a washer 26. Also on the threaded end 22 is a coating 28 suitable for both lubricating and sealing the threaded end 22. Typical of coating 28 is any silicone caulk, which serves as both a lubricant for installation purposes and a sealant to prevent leaks. Any threaded area or other desired area may include coating 28.

Adjacent the outlet 24 and oppositely disposed from the male threaded end 22 is a flange 30. Flange 30 has washer 26 abutted thereagainst for the purpose of further sealing the outlet 42 (shown in FIG. III) or inlet 20 to the tub 12. Washer 26 is adjacent male threaded end 22. A nozzle cavity 40 protrudes down through the nozzle 20 and forms a tubular effect connecting the nozzle to the ninety degree (90°) elbow 60. In this manner, water may flow through the nozzle and form the desired whirlpool effect.

Referring now to FIG. II, ninety degree (90°) elbow 60 is shown as having a nozzle end 61 and a bent rigid tube 72 secured in hose end 64. Hose end 64 provides a slip glue fitting for securing bent rigid tube 72 or rigid pipe 68. Hose end 64 forms the female portion of the fitting. Bent rigid tube 72 or rigid pipe 68 (shown in FIG. IV) or flexible hose 66 (shown in FIG. III) form the male portion of the fitting.

Oppositely disposed from hose end 64 of ninety degree (90°) elbow 60 is nozzle end 61. Nozzle end 61 includes female threads 62 for receiving male threaded end 22. It thus becomes a simple matter to connect nozzle 20 to female threaded end 61.

FIG. III depicts outlet 42 having a cover 32, with flanged ninety degree elbow 43. Flanged 90° elbow 43 is equivalent to ninety degree elbow 60. Outlet 42 is similar in structure to nozzle inlet 20. Within a cover center 38 of cover 32 are a plurality of suction holes 26. Side apertures 27 within cover 32 are on the side 29 of cover 32. Side 29 cooperates with cover center 38 to form a cup like arrangement. A cover cavity 41 of cover 32 protrudes down the center of cover 32 and forms a tubular effect as in nozzle 20. An outlet cavity 40 protrudes down through the center of outlet 42 and forms a tubular structure as in nozzle 20. Cover cavity 41 and outlet cavity 40 cooperate to permit water flow—so that water may return to the pump (not shown) for reentry of tub 12 through nozzle 20 and form the desired whirlpool effect.

Cover 32 includes indentations 36 for receiving a standard tool (not shown) to provide leverage for mounting cover 32 on outlet 42. Outlet 42 has a female outlet threaded portion 44 for receiving the male threads of mounting cover threaded portion 46 in order to secure mounting cover 32 to outlet 42. Mounting cover 32 prevents the return of material other than water to the pump (for example as shown in the cited Ebert patent). Mounting cover threaded portion 46 is also tubular in nature to cooperate with the water flow in a whirlpool bath.

Within cover 32 is a plurality of suction holes 38. A nozzle cavity 40 protrudes down through the outlet 42 and forms a tubular effect as in nozzle 20. In this manner, water may return to the pump for reentry of tub 12 through nozzle 20 and form the desired whirlpool effect.

In FIG. IV, ninety degree (90°) elbow 60 is shown as being secured to rigid pipe 68 by gluing or other means. Rigid pipe 68 is then connected to flexible hose 66 by connector 70. Connector 70 forms the female portion of this connection with rigid pipe 68 or flexible hose 66 forming the male portions. Securing is by gluing or other suitable means. This rearrangement of flexible hose 66, and securing flexible hose 66 to rigid pipe 68 permits a high degree of flexibility for the installation of the whirlpool bath in an in-place bathtub.

FIG. V depicts an installation hook 90 having a long arm 92 and an angle grabber 94 at a rod angle 96 to long arm 92. Rod angle 97 may be an acute angle, an obtuse angle or a right angle. It is preferred that rod angle 96 be between seventy five (75°) degrees and ninety (90°) degrees. Angle grabber 94 is inserted into ninety degree (90°) elbow 60 and used to hold ninety degree (90°) elbow 60 in-place while nozzle 20 or inlet 42 is slid over arm 92 and threadably secured to female threaded end 62. In this fashion, the mounting portion in this structure is achieved.

Appropriate lengths of flexible hose 66 or rigid pipe 68 are glued or otherwise assembled to ninety degree (90°) elbow 60. Hose end 64 provides a slip glue fitting for securing flexible hose 66 or rigid pipe 68. Hose end 64 forms the female portion of the fitting. Flexible hose 66 or rigid pipe 68 form the male portion of the fitting. This assembly can then be inserted between inner wall 14 and outer wall 13 of tub 12 (shown in FIG. VI), and ninety degree (90°) elbow 60 grabbed by installation hook 90.

In FIG. VI, a cutaway version of tub 12 is shown. Ninety degree (90°) elbow 60 appears between the outer wall 13 and inner wall 14 of tub 12. Outlet 42 or nozzle inlet 20 appear on water side 15 of inner wall 14. Male threaded end 22 of nozzle 20 or outlet 42 passes through tub aperture 16 into female threaded end 62 of ninety degree (90°) elbow 60. Because tub aperture 16 has a smaller diameter that does ninety degree (90°) elbow 60, tightening of male threaded end 22 into female threaded end 62 locks nozzle 20 or outlet 42 into place.

Whether tub 12 is fiberglass or porcelain, tub aperture 16 may be formed in tub 12 as set forth in U.S. Pat. No. 4,419,775 to Thomas P. Ebert, the named inventor of this application. This structure eliminates the necessity for tapping or otherwise forming mounting screw holes in tub 12.

In FIG. VII, house wall 17 is shown to indicate a standard wall structure in a home surrounding tub 12. A wall aperture 18 can be formed in order to give access to the tub 12 in order to make the desired installation. Nozzle 20 or outlet 42 are secured in the tub.

The pipe and nozzle aspects of this invention can be made from any suitable material. Typical of the material that can be used is set forth in the above referenced Ebert patent. Male—female connectors disclosed herein may be partially or completely reversed.

Because of this disclosure and solely because of this disclosure, certain modifications of the threaded assembly and mounting procedures therefor disclosed and claimed herein can become obvious to a person of ordinary skill in this art. Such modifications are clearly covered hereby.

What is claimed and sought to be secured by Letters Patents of the United States is:

1. In a method for installing a whirlpool bath in an in-place bathtub by providing a tub, a pump assembly, a water inlet and a water outlet within said tub, a connecting means for connecting said pump assembly to said inlet and said outlet, the improvement wherein:

a. a threaded assembly is provided to mount said inlet or said outlet within said tub;

(1) said threaded assembly includes a nozzle and a ninety degree elbow;

(2) said nozzle includes a nozzle cavity passing therethrough in a tubular fashion to permit passage of water;

(3) said nozzle has a nozzle male threaded end on a first side thereof and a nozzle flange oppositely disposed from said nozzle male threaded end;

(4) said ninety degree elbow has a nozzle end and a hose end oppositely disposed from said nozzle end;

(5) said hose end provides a slip glue fitting for securing said connecting means to said pump; and (6) said nozzle end includes a female threaded portion for receiving said nozzle male threaded end;

b. a tub aperture is formed in a water contact wall of said tub;

c. an access between a pair of walls of said tub is formed;

d. said threaded assembly is fed through said access and between said walls of said tub;

e. an installation hook having a long arm and an angle grabber is inserted from said water wall of said tub through said tub aperture at said angle grabber to grab and hold said ninety degree elbow nozzle while said nozzle male threaded end is threadably secured to said female threaded portion in said ninety degree elbow by sliding said nozzle over said long arm; said nozzle being thus secured on said water wall of said tub and ninety degree elbow being secured between said walls of said tub.

2. The method of claim 1 wherein said installation hook has a long arm and an angle grabber at a rod angle to said long arm wherein said rod angle is an acute angle, an obtuse angle or a right angle.

3. The method of claim 2 wherein said rod angle is between seventy five degrees and ninety degrees.

* * * * *